US006144814A

United States Patent [19]

Newell, Jr. et al.

[11] Patent Number: 6,144,814

[45] Date of Patent: Nov. 7, 2000

[54] METHOD FOR AUTOMATICALLY COMPLYING WITH A PAGE STOP SPECIFICATION IN A PRINTING DEVICE

[75] Inventors: Lawrence Bert Newell, Jr., Jalisco, Mexico; Ricardo Osuna Leyva, Boise, Id.

[73] Assignee: Hewlett-Packard Company, Palo Alto, Calif.

[21] Appl. No.: 09/443,952

[22] Filed: Nov. 19, 1999

[51] Int. Cl.[7] ..... G03G 15/00; B65H 5/22

[52] U.S. Cl. ..... 399/16; 271/3.15; 271/3.16; 399/23

[58] Field of Search ..... 399/16, 9, 18, 399/23, 381, 388, 389, 391, 396, 66, 401, 402; 271/256, 3.14, 3.15, 3.16, 3.17, 9.02; 395/111; 347/5, 16, 104

[56] References Cited

U.S. PATENT DOCUMENTS 6,047,148 4/2000 Nagatani et al. ..... 399/66

*Primary Examiner*—Arthur T. Grimley
*Assistant Examiner*—Hoan Tran

[57] ABSTRACT

A method and apparatus are disclosed for automatically calibrating media feed timing operations for both internal media handling and for media transfers between coupled feeder and receiving devices. Each of the devices is equipped with a microprocessor and a read-only memory (ROM) for program storage. A stop location is determined for the media feed path of each receiving device. In addition, the media path of each feeder device is equipped with a media detection sensor near its exit. The distance between this sensor and the media path exit of the feeder device may be determined by manual measurement. In addition, each feeder device must "know" the speed at which it transports pages along the media path. Each feeder device is given the page stop specifications of any attached receiving devices over a communication bus at system boot-up. The feeder device will then use that information to set its page advancement motor timer to a value which will result in media pages being moved from the feeder device to the proper location in the receiving device.

20 Claims, 3 Drawing Sheets

METHOD FOR AUTOMATICALLY COMPLYING WITH A PAGE STOP SPECIFICATION IN A PRINTING DEVICE

FIELD OF THE INVENTION

This invention relates to printing devices and, more particularly, to methods employed to ensure that a page entering the media feed path of a printing device such as a printer, copier, or facsimile machine complies with the page stop specification for that device.

BACKGROUND OF THE INVENTION

Dedicated printers, copiers and facsimile machines all have multiple sheet printing capabilities requiring a feeder mechanism which inserts sheets into a media feed path. The recent trend has been for suppliers of such equipment to combine multiple functions in a single device. For example, digital printing devices are now available that can function as either a copier or as a printer. Other digital printing devices combine printing, copying, facsimile and scanning functions. Each such printing device generally has at least one of what is known in the industry as a page stop location. A page stop location is the furthest position to which a new page may be inserted into a media path without that page interfering with the movement of other media sheets already in the path, or with moving mechanical components within the device. The stop location can apply to media sheets being fed into an internal media path, or to media sheets being fed from the media transport path of one device to the media transport path of another device. A new page must not pass the stop location until the printing device is ready to receive it. Stop locations are usually stated as a distance from the media path entrance. For devices which are externally attachable to a host device, the path entrance is generally located on a face of the attachable device, a face which generally mounts flush with a receiving face of the host device.

The page stop value of a device is a critical factor as pages are fed into its media path entrance. If, for example, the actual page stop location is 28.4 mm, a media jam will occur if the media page is stopped beyond that value at, say, 28.5 mm. Because of certain variables, such as thermal expansion and mechanical tolerances, a page stop specification is generally given as an optimum distance value with a tolerance. Even in the case where the tolerance is at the high-side maximum, the value still provides at least some leeway against a jam condition. For an actual page stop location of 28.4 mm, the page stop specification might be given as 26.4 mm±1.0 mm. Thus, even if a newly-fed page stops at 27.4 mm (the high-side tolerance), the page is still 1.0 mm from causing a jam condition.

Heretofore, the parking of media sheets just short of a stop location has been empirically determined by estimating how long it will take for the sheet to travel from an identifiable starting point along the media path to the stop location. A timer, set to the estimated time, begins a countdown to zero as a media page passes a sensor identifying the starting point. Movement of the page along the media path is stopped when the timer expires, and the page is checked for proper positioning at the stop location. The process is repeated until the time for proper positioning to be achieved is accurately known.

The integration of a printing device with one or more attached devices, such as media input handlers, collators, binders, mailers or duplexing attachments, is time consuming because each device which feeds media sheets to another device must know the stop location of the receiving device in order to prevent media jams when a media sheet is transferred from the feed device to the receiving device.

What is needed is a method for automatically calibrating media feed timing for the stop locations of interconnected devices so that development and integration of multiple device systems is no longer a cumbersome, time-consuming task.

SUMMARY OF THE INVENTION

This invention provides a method for automatically establishing media feed timing operations for media transfers between devices. In this disclosure, the terms "page" and "sheet" may be used interchangeably. Each of the devices is equipped with a microprocessor and a read-only memory (ROM) for program storage. A stop location is determined on media feed path for each device which receives media pages from a feeder device. In addition, the media path of each feeder device is equipped with a media detection sensor near the path exit. The distance between this sensor and the media path exit on a particular device is most easily determined by manual measurement. In addition, each feeder device must "know" the speed at which media pages are transported along its media path. Speed calibration can be performed at the manufacturing stage, or may be performed by the device itself. By equipping the media path with a pair of page detection sensors spaced a known fixed distance apart, and having the device move a page along the path so that the sensors sequentially start and stop a timer, the page transport speed between the two sensors may be readily determined.

In a system of interconnected devices, such as a printer having multiple paper handling devices, each feeder device is given the page stop specifications of any devices to which it delivers media sheets so each feeder can automatically determine the time period required to move a page beyond the point of detection by its page output sensor a stop location of the receiving device. For a preferred embodiment of the invention, page stop specifications are communicated to other devices over a communication bus during a system boot-up sequence. The transmitting device will then use that information to set its page advancement motor timer to a value which will result in media pages being moved from the transmitting device to the proper location in the receiving device.

DETAILED DESCRIPTION OF THE INVENTION

Figure 1:
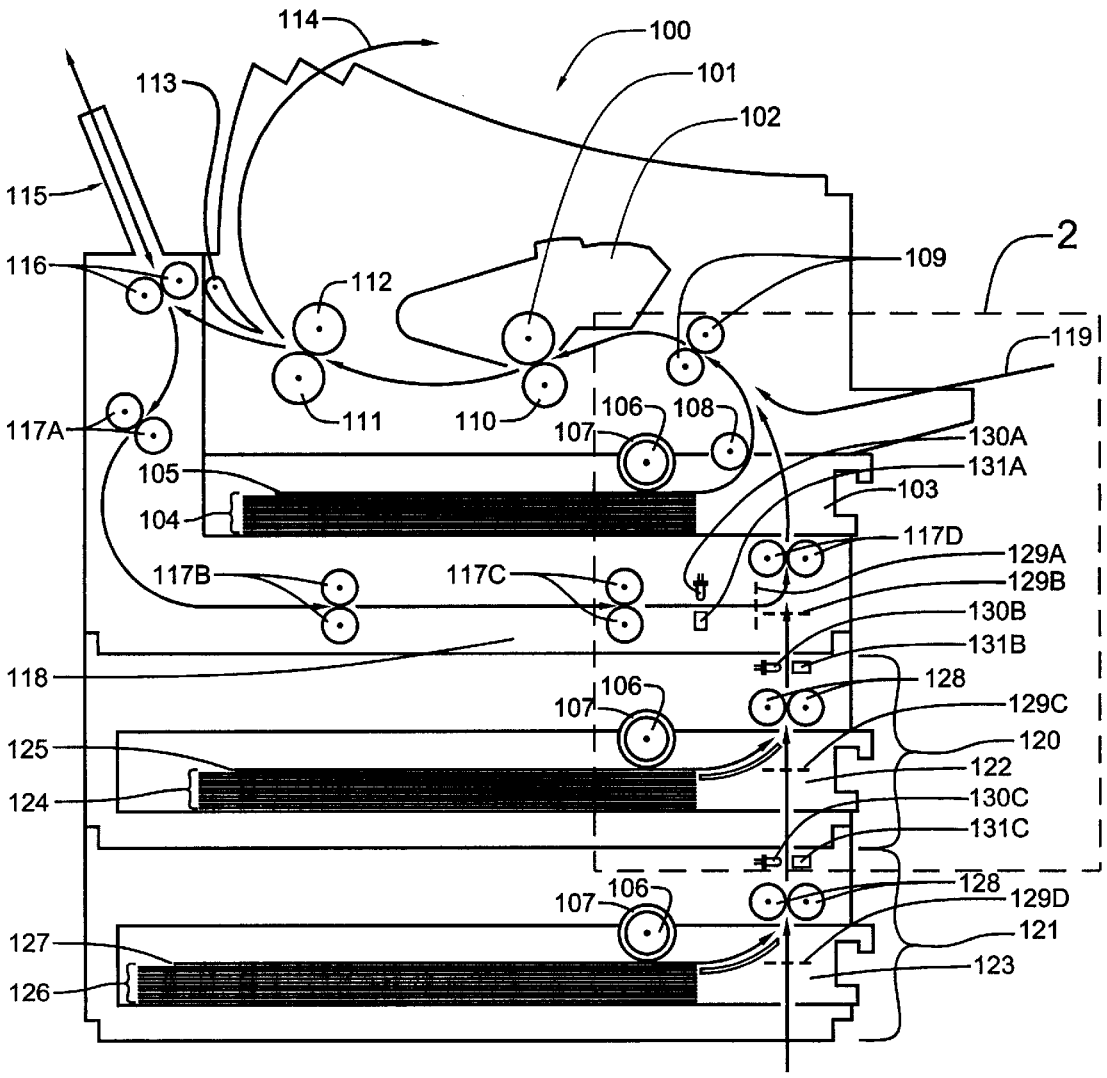
FIG. 1 is a schematic view of a laser printer having two attached media supply attachments.

Referring now to FIG. 1, the invention is incorporated in a laser printer 100 having a first and second media supply attachments (120 and 121, respectively) and both simplex and duplex media feed paths. In this drawing figure and that of FIG. 2, media feed paths are shown as wide, solid lines tipped with an arrow head. A photoconductive drum 101 is rotatably mounted within a toner cartridge assembly 102. In order to create a printable image, the drum 101 is rotated by a stepper motor (not shown) while a laser beam (also not shown) writes a latent electrostatic image thereon, one line at a time. Toner powder is then transferred from within the toner cartridge assembly 102 to the latent electrostatic image on the drum 101. A paper tray 103 provides storage for a stack 104 of singulated media sheets 105. Although xerographic bond paper is the most common print media used in laser printers, envelopes and polymeric transparencies are but two of other additional types of print media. Individual media sheets 105 are dislodged from the top of the stack 104 by a media feed roller 106. The pick-up surface of the media feed roller 106 is generally covered with a layer of resilient polymeric material 107, such as rubber. Passing over a guide roller 108, a dislodged media sheet 105 is fed between a pair of abutting, axially parallel registration rollers 109. The media sheet 105 then passes between the photoconductive drum 101 and a transfer roller 110 thereby transferring the toner powder image to the media sheet 105. As the image bearing media sheet 105 passes between a pressure roller 111 and a heated fuser roller 112, the image is fused onto the surface of the media sheet 105. A pivotable duplexing/simplexing guide 113, which operates much like a railway switch, directs the media sheet 105 having the fused image thereon either to a final exit path 114 for simplex printing, or to a switch back assembly 115 fitted with reversible duplexing rollers 116, which reverses the feed direction of the media sheet 105 for duplex printing. A series of paired transport rollers 117A–117D transports the media sheet 105 to a holding tray 118 beneath the paper tray 103, where the media sheet remains until a new image is applied to the photoconductive drum 101, and then, again, to the registration rollers 109. The printing process then proceeds as before, with the new image being applied to the opposite side of the media sheet 105. This time, the fused sheet exits to the final exit path 114. A manual media feed path 119 may be used for little-used or odd-size media.

Still referring to FIG. 1, each of the media supply attachments (120 and 121) has its own media tray (122 and 123, respectively) loaded with a stack (124 and 126, respectively) of media sheets. In the present case, media tray 103 may be loaded with U.S. standard-size (8½-inch×11-inch) paper sheets 105, media tray 122 may be loaded with A-4 size paper sheets 125, and media tray 123 may be loaded with U.S. legal-size (8½-inch×14-inch) paper sheets 127. The printer 100 may utilize media sheets from any of the three trays. It will be noted that the duplex paper path through media holding tray 118 has a stop location 129A. When the printer 100 is operating in the duplex mode, any sheet returning from the switch-back assembly 115 must stop short of the feed path to allow the completion of media feeds from media tray 122 or media tray 123. Likewise, during duplex mode operation, any media feeds from media trays 122 or 123 may be required to wait for a page in the holding tray 118 to receive printing on its back side. Therefore, the printer has a stop location 129A for the return duplex path and a stop location 129B for the feed paths from the lower media trays 122 and 123. A media detection sensor mounted on the return duplex path, consisting of light-emitting diode 130A and a receptor 131A, provides a trigger signal for timed media advancement so that the media stops just short of stop location 129A. Stop location 129B, on the other hand, relies on the media detection sensor 130B/131B mounted within media supply attachment 120 to provide timed advancement of media from media trays 122 and 123. Though a page stop for a media path internal to a device, such as 129A may be set at the factory for the life of the device, the integration of various devices having one or more page stops on incoming media feed paths is far more complex because of the number of equipment configurations possible. It should be mentioned that a microswitch may be substituted for each diode/receptor pair (130A/131A, 130B/131B, or 130C/131 C)

Still referring to FIG. 1, it will be noted that each of the media supply attachments 120 and 121 has a pass-through media supply path, each of which employs a pair of motor-driven media advancement rollers 128 to advance media sheets therein. In other words, a media sheet from media supply attachment 121 must pass through media supply attachment 120 en route to the printer 100. In such a case, media supply attachment 120 is, like the printer 100, a media receiving device. Thus, media supply attachment 120 may not receive a new media page from media supply attachment 121 until its supply path is clear and it is ready to receive the page. Stop location 129C prevents jams related to path and mechanical conflicts between media supply attachments 120 and 121. Media detection sensor 130C/131 C, mounted within media supply attachment 121, provides timed advancement of media pages from media tray 123 to media supply attachment 120.

Still referring to FIG. 1, a cursory review of the printer and media paths would seem to indicate that path conflicts would not occur when the printer is operating in the duplex mode. However, greater throughput can be obtained from the printer with out-of-order printing. Using such a method, the printing sequence is as follows: Print on the front side of a first page; print on the front side of a second page (this occurs while the first page is reversing sides in the switch-back assembly 115 and traveling beneath the media supply tray 103); print on the back side of the first page; print on the front side of a third page; print on the back side of the second page; and so forth. Because media page flow is nearly continuous, timing is critical. Timed parking of each media page at the page stop location 129A (and at stop location 129B if media sheets are being feed from media supply attachments 120 or 121) and subsequent advancement of the media, when the path ahead is clear and the media transport mechanisms are prepared to receive the media page, prevents path conflicts and jams.

Figure 2:
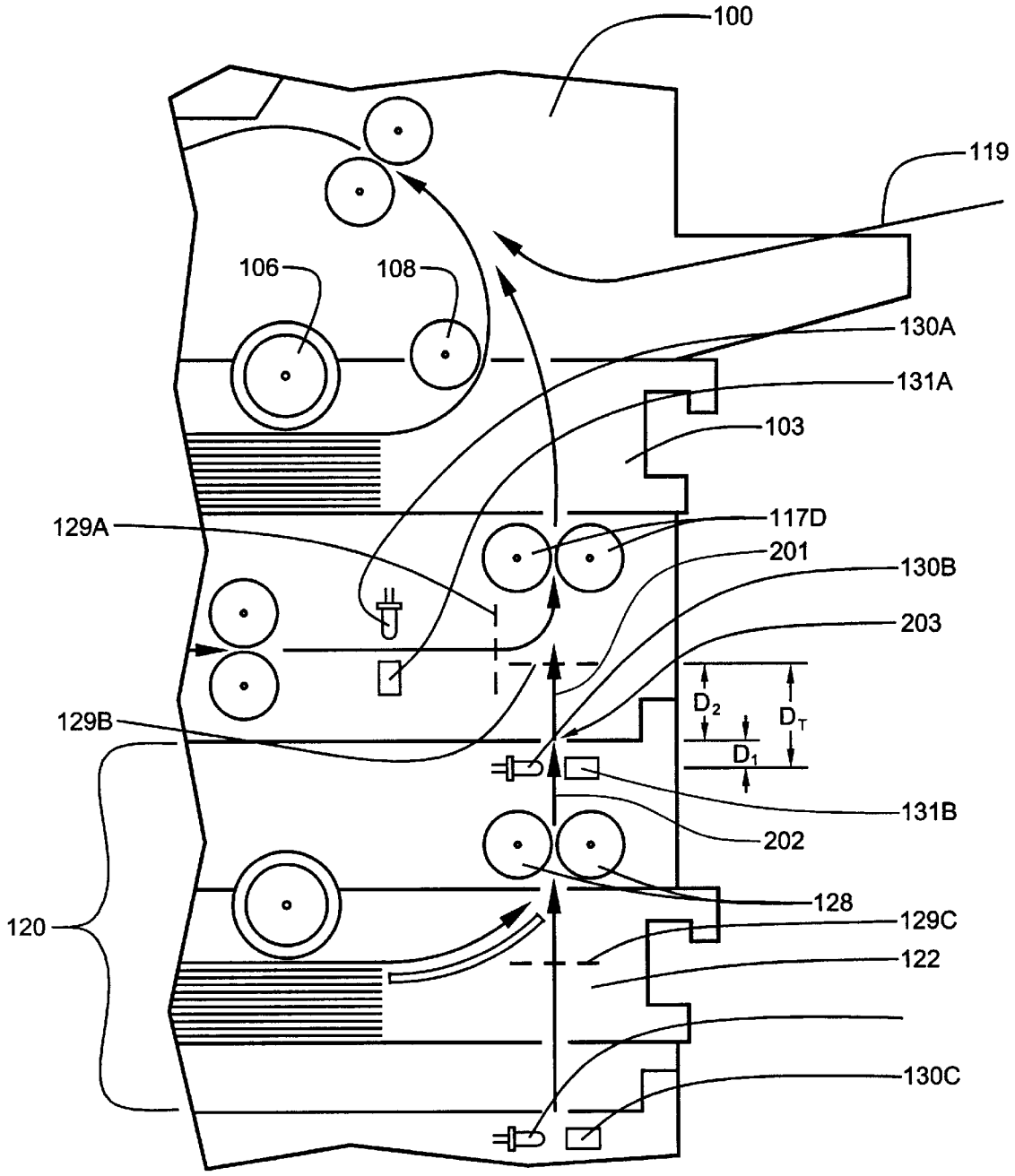
FIG. 2 is a close-up view of the area of FIG. 1 bounded by a dashed rectangle.

Referring now to the enlarged view of FIG. 2, the printer 100 may be considered a receiving device when receiving media sheets from feeder media supply attachment 120, which originate from either media tray 122 or media tray 123. The printer 100 has a media receiving path 201 with an entrance for media sheets tendered thereto. The media supply attachment, on the other hand, has an output media feed path 202 with an exit 203 that is coupled to media receiving feed path 201 of printer 100. In order for a feeder device to stop a page at the page stop specification, the distance between a page detection sensor and the stop location must be known. If the page detection sensor is in a device that is attached to a host device and the page stop location is in the host device, then the total distance DT is computed by adding $D_1$ and $D_2$, $D_1$ being the distance from the sensor to the path exit of the attached device, and $D_2$ being the distance from the path entrance on the host device to the stop location. It is assumed, of course, that since the two devices are closely coupled, the path exit 203 from the attached device corresponds to the path entrance 203 to the host device. In order to stop a page at the proper location, the speed, V, at which it is transported along the media path must also be known. The speed V can be determined either experimentally by the designer, or by the device itself by. By equipping the media path with a pair of media detection sensors spaced apart a known distance, a device can automatically calibrate itself at system boot-up and determine the speed of an advancing media page by having the first sensor start a timer and the second sensor stop the timer. Because media advance speed calibration is not the focus of this invention, an additional calibration sensor is not shown in the drawing figures. Suffice it to say that if another sensor similar to sensor 130B/131B were located between roller pair 128 and sensor 130B/131 B, such calibration could be readily effected. In any case, once the speed V has been ascertained, the time required for a media page to advance to the stop location after triggering its associated sensor, $t_R$, is equal to DT/V. Each media supply attachment 120 or 121 incorporates an electric motor (shown in FIG. 3), which drives the media advancement rollers 128 of its respective device. The motor is coupled to a timer (item 306 of FIG. 3) set to the $t_R$ value. When the timer expires and the page advancement motor is shut off, the page will have been advanced to the proper location. Because a spinning motor has some angular momentum, it may be necessary to either brake the motor or compensate for the momentum by reducing $t_R$ accordingly.

Figure 3:
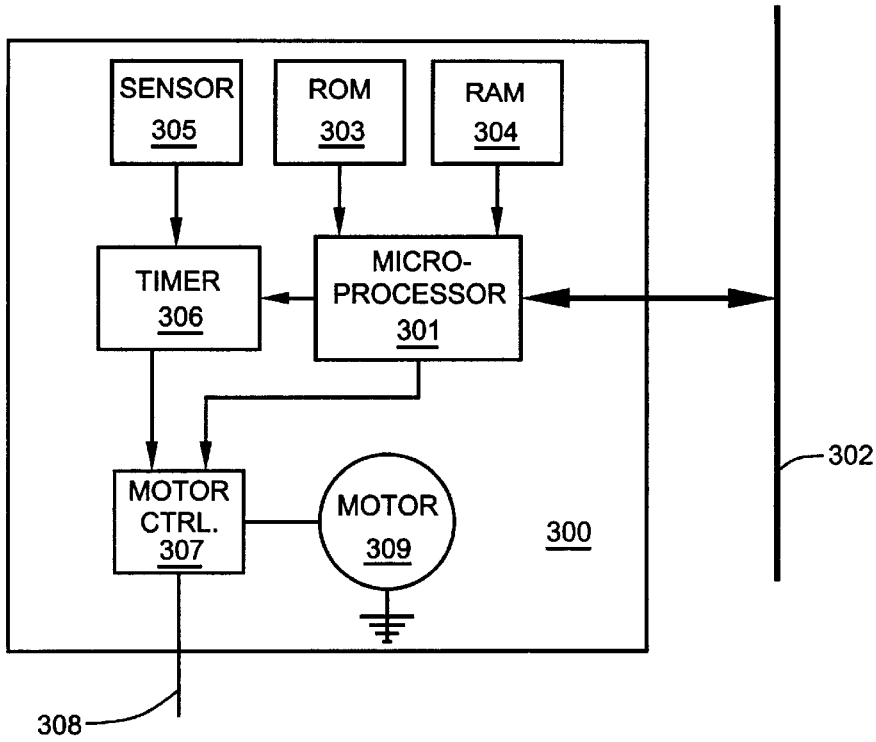
FIG. 3 is a simplified block diagram of printer electronics required to implement the present invention.

Referring now to FIG. 3, each device such as media supply attachments 120 or 121 includes device electronics 300. The device electronics 300 include a microprocessor 301, a read-only memory 303, a timer 306, a sensor 305, a solenoid-containing motor controller 307, and a motor 309 which drives a media advancement roller pair 128. Though not absolutely required to implement the present invention, the device electronics 300 may include a random access memory 304. As a practical matter, all modern printers incorporate varying amounts of random access memory. Alternatively, both the ROM 303 and the RAM 304 may be replaced by non-volatile, rewritable memory such as flash memory. The microprocessor 301 communicates with a system communication bus 302. The read-only memory 303 provides storage for processor control routines, the D, value for that device as well as the page advancement speed for that device if that value was determined at the time of manufacture. The random access memory 304 may provide storage for loading page stop specifications of coupled devices to which media sheets are fed. The microprocessor 301 calculates a $D_T$ value for the page stop specification of each coupled device, then calculates $D_T$/V in order to obtain a value for $t_R$. The timer 306 is coupled to the sensor 305, which may be either a micro switch sensor or an LED sensor, such as 130A/131A, 130B/131 B, or 130C/131 C. The timer 306 is set with the $t_R$ value. When the sensor 305 detects a moving media page, it triggers the timer 306. The timer 306, in response, sends a signal to the motor controller 307, which by activating its solenoid, couples the motor 309 to a DC power source 308 until the timer 306 expires. While the motor 309 is coupled to the power source 308, the paper advancement rollers 128 rotate and advance the media page. It should be mentioned that the timer might simply be a register within the microprocessor 301. In addition, the RAM 304 may be eliminated from this invention by using registers within the microprocessor 301 to hold page stop specifications of coupled devices until a $t_R$ value can be calculated. It should also be mentioned that control of the motor 309 may be exercised by the microprocessor 301, independent of the path through timer 306. As a practical matter, the printer 100 may also act as a feeder device to other devices such as collators or staplers. Thus, it will also have its own microprocessor, ROM, media sheet detector, timer, motor controller and media sheet advancement motor. Although the electronics of a feeder device and the receiving device may be identical, as a matter of clarification, the letter "A" is appended to the electronic components of the receiving device, while the letter "B" is appended to the electronic components of the feeder device. For example, the microprocessor of the printer would be item 301A, while the microprocessor of the feeder device (in this case media supply attachment 120) would be item 301B.

Figure 4:
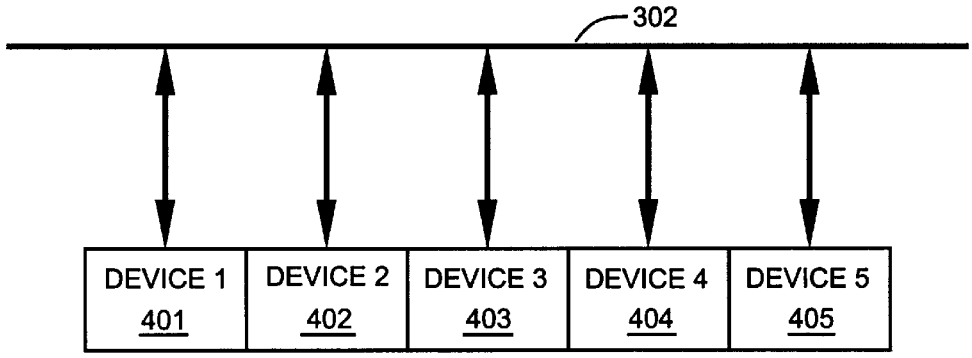
FIG. 4 shows a system of five interconnected devices which share information over a communication bus.

Referring now to FIG. 4, a system having five interconnected devices (401, 402, 403, 404, and 405 ) is shown. Each device communicates with the device electronics 300 of other attached devices over the communication bus 302 so that a proper $t_R$ value may be calculated for each device to which that device is attached. Each paper transmitting device will then use that information to set its page transport motor timer to a value which will result in media pages being moved from the transmitting device to the proper location in the receiving device.

Although only a single embodiment of the invention has been heretofore described, it will be obvious to those having ordinary skill in the art that changes and modifications may be made thereto without departing from the scope and the spirit of the invention as hereinafter claimed.

What is claimed is:

1. In a system of at least two adjacent interconnected devices, one of which is a feeder device which advances media sheets from its media feed path exit into the media feed path entrance of a receiving device, a method for automatically complying with a page stop specification of the receiving device, said method comprising the steps of:

providing a communication bus;

equipping said receiving device with a first microprocessor coupled to said communication bus and a first memory accessible by said first microprocessor for storing both a page stop specification value $D_2$ for said receiving device and an instruction which commands said first microprocessor to post said page stop specification to said communication bus;

equipping the feeder device with a second microprocessor coupled to said communication bus, a media advancement motor providing a media advancement speed (V); a timer for setting a time remaining $t_R$ for motor operation; a page detection sensor located along the feeder device's media feed path prior to said exit, said sensor triggering said timer upon detecting an arrival of a page at the sensor location; and a second memory for storing a path distance value ($D_1$) from said sensor to said exit, the media advancement speed (V) and processor-controlling routines which command said second microprocessor to monitor said bus at system boot-up, fetch $D_2$ from said bus, add $D_1$ and $D_2$, divide the result by V to obtain said time remaining value $t_R$, and set said timer to $t_R$.

2. The method of claim 1, wherein said first and second memories are of the read-only type.

3. The method of claim 1, which further comprises the step of equipping said feeder device with a motor controller which couples said motor to a DC power source, said controller receiving signals from both said timer and said second microprocessor, signals from said timer taking precedence over prior signals received from said second microprocessor.

4. The method of claim 3, wherein said motor controller incorporates a solenoid for coupling and decoupling said DC power.

5. The method of claim 1, wherein said receiving device is a printing device.

6. The method of claim 1, wherein said receiving device is selected from the group consisting of printers and copiers.

7. The method of claim 1, wherein said feeder device is selected from the group consisting of media input handlers, collators, binders, mailers and duplexing attachments.

8. The method of claim 1, wherein said first microprocessor posts said page stop specification to said communication bus at system boot-up.

9. The method of claim 1, wherein said timer includes a register into which said time remaining value $t_R$ is loaded.

10. The method of claim 1, wherein said timer is a register within said microprocessor.

11. A printing system comprising:

a communication bus;

at least one receiving device having a first media feed path with an entrance for receiving media sheets tendered thereto, said first media feed path having a page stop location beyond which said media sheets may not be advanced until said receiving device is ready to receive them, said receiving device also having a first microprocessor coupled to said communication bus and a first memory accessible by said first microprocessor for storing both a numeric value $D_2$ representative of said page stop location and an instruction which commands said first microprocessor to post said page stop specification to said communication bus;

at least one feeder device adjacent and interconnected with said receiving device, said feeder device having a second media feed path coupled to said first path, said feeder device advancing media sheets from an exit of said second path to the entrance of said first path, said feeder device also having a second microprocessor coupled to said communication bus, a media advancement motor providing a media advancement speed (V), a timer for setting a time remaining $t_R$ for motor operation; a page detection sensor located along said second path prior to said exit, said sensor triggering said timer upon detecting an arrival of a page at the sensor location; and a second memory for storing, as numeric values, the path distance ($D_2$) from said sensor to said exit, the media advancement speed (V), as well as processor-controlling routines which command said second microprocessor to monitor said bus at system boot-up, fetch $D_2$ from said bus, add $D_1$ and $D_2$, divide the result by V to obtain said time remaining value $t_R$, and set said timer to $t_R$.

12. The printing system of claim 11, wherein said first and second memories are of the read-only type.

13. The printing system of claim 11, wherein said feeder device further comprises a motor controller which couples said motor to a DC power source, said controller receiving signals from both said timer and said second microprocessor, signals from said timer taking precedence over prior signals received from said second microprocessor.

14. The printing system of claim 13, wherein said motor controller incorporates a solenoid for coupling and decoupling said DC power.

15. The printing system of claim 11, wherein said receiving device is a printing device.

16. The printing system of claim 11, wherein said receiving device is selected from the group consisting of printers and copiers.

17. The printing system of claim 11, wherein said feeder device is selected from the group consisting of media input handlers, collators, binders, mailers and duplexing attachments.

18. The printing system of claim 11, wherein said first microprocessor posts said page stop specification to said communication bus at system boot-up.

19. The printing system of claim 11, wherein said timer includes a register into which said time remaining value $t_R$ is loaded.

20. The printing system of claim 11, wherein a register of said microprocessor provides the timer function.

* * * * *